US008515305B2

(12) United States Patent
Nonaka et al.

(10) Patent No.: US 8,515,305 B2
(45) Date of Patent: Aug. 20, 2013

(54) CLEANING UNIT INCLUDING AN ELASTIC MEMBER SPIRALLY WOUND AROUND AND FIXED TO A SHAFT

(75) Inventors: Akihiro Nonaka, Kanagawa (JP); Takeshi Kawai, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 385 days.

(21) Appl. No.: 13/021,327

(22) Filed: Feb. 4, 2011

(65) Prior Publication Data

US 2012/0076528 A1 Mar. 29, 2012

(30) Foreign Application Priority Data

Sep. 27, 2010 (JP) ..... 2010-215631

(51) Int. Cl.
*G03G 15/02* (2006.01)

(52) U.S. Cl.
USPC ..... 399/100

(58) Field of Classification Search
USPC ..... 399/100, 176, 357
See application file for complete search history.

(56) References Cited

U.S. PATENT DOCUMENTS

| | | | | |
|---|---|---|---|---|
| 8,183,464 | B2 | 5/2012 | Yamakami et al. | |
| 8,290,391 | B2 * | 10/2012 | Kawahara | 399/100 |
| 8,320,790 | B2 * | 11/2012 | Yamaguchi | 399/100 |
| 8,391,745 | B2 * | 3/2013 | Nishikawa et al. | 399/100 |
| 8,401,421 | B2 * | 3/2013 | Kawai | 399/100 |
| 2009/0145653 | A1 | 6/2009 | Yamakami et al. | |

FOREIGN PATENT DOCUMENTS

| | | |
|---|---|---|
| JP | A-8-137208 | 5/1996 |
| JP | A-2009-141170 | 6/2009 |

OTHER PUBLICATIONS

Feb. 26, 2013 Japanese Office Action issued in Japanese Patent Application No. 2010-215631 (with translation).

* cited by examiner

*Primary Examiner* — William J Royer
(74) *Attorney, Agent, or Firm* — Oliff & Berridge, PLC

(57) ABSTRACT

A cleaning unit includes a shaft that is rotatable; an elastic layer that is spirally wound around and fixed to the shaft, the elastic layer contacting and cleaning an object to be cleaned; a pressed portion that protrudes from each end portion of the elastic layer in an axial direction of the shaft, in a part of the each end portion with respect to a width direction of the elastic layer; and a pressing member that is arranged at an end portion of the shaft in the axial direction, the pressing member pressing the pressed portion between the pressing member and the shaft.

11 Claims, 8 Drawing Sheets

CLEANING UNIT INCLUDING AN ELASTIC MEMBER SPIRALLY WOUND AROUND AND FIXED TO A SHAFT

CROSS-REFERENCE TO RELATED APPLICATIONS

This application is based on and claims priority under 35 USC 119 from Japanese Patent Application No. 2010-215631 filed Sep. 27, 2010.

BACKGROUND

Technical Field

The present invention relates to a cleaning unit, a cleaning device, a charging device, an assembly, and an image forming apparatus.

SUMMARY

According to an aspect of the present invention, a cleaning unit includes a shaft that is rotatable; an elastic layer that is spirally wound around and fixed to the shaft, the elastic layer contacting and cleaning an object to be cleaned; a pressed portion that protrudes from each end portion of the elastic layer in an axial direction of the shaft, in a part of the each end portion with respect to a width direction of the elastic layer; and a pressing member that is arranged at an end portion of the shaft in the axial direction, the pressing member pressing the pressed portion between the pressing member and the shaft.

BRIEF DESCRIPTION OF THE DRAWINGS

Exemplary embodiments of the present invention will be described in detail based on the following figures, wherein.

DETAILED DESCRIPTION

Hereinafter, an exemplary embodiment of the present invention will be described with reference to the drawings.

Figure 1:
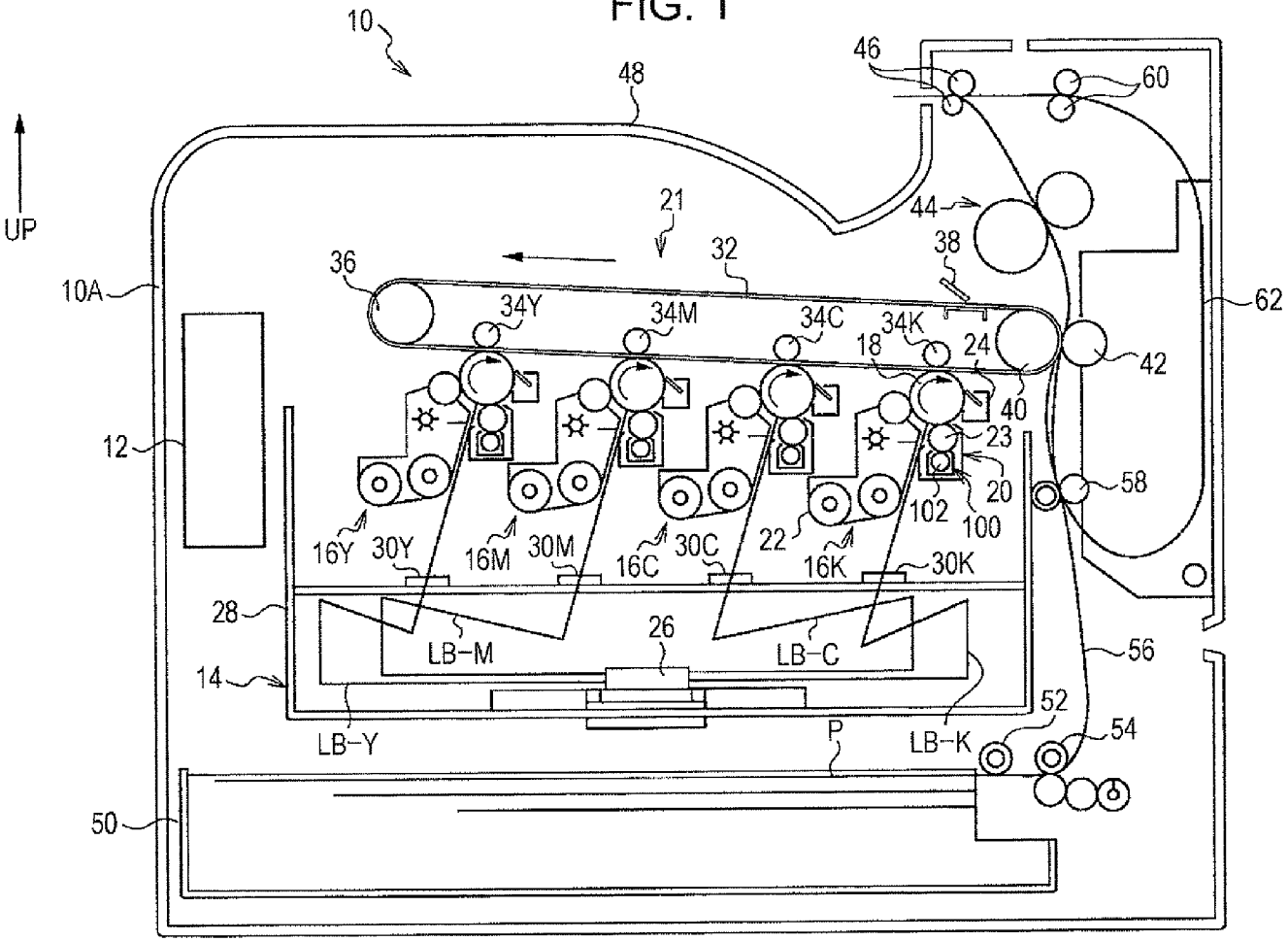
FIG. 1 is a schematic view illustrating the structure of an image forming apparatus.

First, the structure of an image forming apparatus 10 will be described. As illustrated in FIG. 1, an image processor 12 is arranged in an apparatus body 10A of the image forming apparatus 10. The image processor 12 performs image processing on input image data.

The image processor 12 processes the input image data into gradation data for four colors, i.e., yellow (Y), magenta (M), cyan (C), and black (K). An exposing device 14, which is arranged at substantially the center of the apparatus body 10A, receives the gradation data and performs exposure using a laser beam LB-Y, LB-M, LB-C, and LB-K.

Above the exposing device 14, four image forming units 16Y, 16M, 16C, and 16K, respectively for yellow (Y), magenta (M), cyan (C), and black (K), are arranged with distances therebetween in the horizontal direction. Hereinafter, when it is not necessary to distinguish between Y, M, C, and K, the letters Y, M, C, and K may be omitted.

These four image forming units 16Y, 16M, 16C, and 16K have the same structure. Each of the image forming units 16 includes an image carrier 18, a charging device 20, a developing device 22, and a cleaning member 24. The image carrier 18 is an example of a member to be charged that is rotated and that is cylindrical. The charging device 20 charges the outer peripheral surface of the image carrier 18. The developing device 22 develops an electrostatic latent image, which has been formed by exposure to light performed by the exposing device 14, on the outer peripheral surface of the image carrier 18 that has been charged by the charging device 20 by using toner of different colors so as to form a visible toner image. The cleaning member 24 cleans the outer peripheral surface of the image carrier 18.

The image carrier 18, which is a photoconductor, is capable of holding an image that is formed. The charging device 20 includes a charging roller 23 and a cleaning device 100. The charging roller 23 is an example of a charging member that charges the outer peripheral surface of the image carrier 18. The cleaning device 100 cleans the charging roller 23.

The charging roller 23 rotates while being in contact with the outer peripheral surface of the image carrier 18, and charges the outer peripheral surface of the image carrier 18. The charging roller 23 is also an example of an object to be cleaned by the cleaning device 100. The structure of the cleaning device 100 will be described below in detail.

Each of the image forming units 16Y, 16M, 16C, and 16K are removable from the apparatus body 10A, and functions as an assembly that is removably assembled in the apparatus body 10A. Alternatively, the image forming units 16Y, 16M, 16C, and 16K need not be formed as units and may be, for example, supported by a common supporting frame. In this case, the image forming units 16 need not be removable from the apparatus body 10A.

The exposing device 14 includes four semiconductor lasers (not shown) that correspond to the four image forming units 16Y, 16M, 16C, and 16K. The semiconductor lasers emit laser beams LB-Y, LB-M, LB-C, and LB-K in accordance with the gradation data.

Each of the laser beams LB-Y, LB-M, LB-C, and LB-K, which is emitted from the semiconductor lasers, passes through (not shown) an f-θ lens and is incident on a polygon mirror 26 that rotates, and is deflectively scanned by the polygon mirror 26. Then, each of the laser beams LB-Y, LB-M, LB-C, and LB-K, which is deflectively scanned by the polygon mirror 26, passes through an imaging lens (not shown) and is reflected by plural mirrors (not shown), and is incident on an exposure point on the image carrier 18 diagonally from below.

The exposing device 14 is sealed in a housing 28 having a rectangular-parallelepiped shape. Transparent members 30Y, 30M, 30C, and 30K, which transmit the four laser beams LB-Y, LB-M, LB-C, and LB-K toward the image carriers 18 of the image forming units 16Y, 16M, 16C, and 16K, are arranged on the housing 28.

An intermediate transfer unit 21 is arranged above the image forming units 16Y, 16M, 16C, and 16K. The intermediate transfer unit 21 includes an intermediate transfer belt 32, a drive roller 40, a tension roller 36, and first transfer rollers 34Y, 34M, 34C, and 34K. The intermediate transfer belt 32, which is an endless belt, is looped over the drive roller 40 and the tension roller 36. The drive roller 40 rotates so as to rotate the intermediate transfer belt 32 in the direction of an arrow illustrated in FIG. 1. The tension roller 36 applies a tension to the intermediate transfer belt 32. A cleaning member 38 cleans the outer peripheral surface of the intermediate transfer belt 32. The first transfer rollers 34Y, 34M, 34C, and 34K are arranged on a side of the intermediate transfer belt 32 opposite to the side on which the image carriers 18 are arranged.

The four first transfer rollers 34Y, 34M, 34C, and 34K multilayer-transfer the toner images having yellow (Y), magenta (M), cyan (C), and black (K) colors, which have been successively formed on the image carriers 18 of the image forming units 16Y, 16M, 16C, and 16K, onto the intermediate transfer belt 32.

A second transfer roller 42 is arranged opposite to the drive roller 40 with the intermediate transfer belt 32 therebetween. The toner images having yellow (Y), magenta (M), cyan (C), and black (K) colors, which have been multilayer-transferred onto the intermediate transfer belt 32, are transported by the intermediate transfer belt 32 to a second transfer position that is between the drive roller 40 and the second transfer roller 42, and then second-transferred to a recording medium P, which has been transported along a transport path 56.

A fixing device 44 is arranged downstream of the second transfer roller 42 in the transport direction of the recording medium P (hereinafter, simply referred to as "downstream"). The fixing device 44 fixes the toner images, which have been transferred to the recording medium P, onto the recording medium P by heat and pressure. Output rollers 46 are arranged downstream of the fixing device 44. The output rollers 46 output the recording medium P, onto which the toner images have been fixed, to an output section 48 that is arranged on the upper part of the apparatus body 10A of the image forming apparatus 10.

A container 50 and a feed roller 52 are arranged in a lower part of the apparatus body 10A of the image forming apparatus 10. The container 50 contains recording medium P, and the feed roller 52 feeds the recording medium P to the transport path 56. A separation roller 54 is arranged downstream of the feed roller 52. The separation roller 54 separates the recording medium P one by one and transports the separated recording medium P.

A positioning roller 58 is arranged downstream of the separation roller 54. The positioning roller 58 adjusts a transport timing. Thus, the recording medium P, which has been fed from the container 50, is transported by the positioning roller 58 at a predetermined timing to a second transfer position at which the intermediate transfer belt 32 and the second transfer roller 42 contact each other.

Transport rollers 60 are arranged adjacent to the output rollers 46. The transport rollers 60 transport the recording medium P onto which the fixing device 44 has fixed the toner images and that has not been output to the output section 48 by the output rollers 46, to a duplex transport path 62. The recording medium P, which is transported along the duplex transport path 62, is reversed and transported to the positioning roller 58 again. This time, toner images are transferred to and fixed onto the back surface of the recording medium P, and the recording medium P is output to the output section 48.

The image forming apparatus 10, which has the structure described above, forms an image on the recording medium P as follows. First, the image processor 12 successively outputs gradation data for different colors to the exposing device 14. The exposing device 14 emits laser beams LB-Y, LB-M, LB-C, and LB-K in accordance with the gradation data. The laser beams LB-Y, LB-M, LB-C, and LB-K are scanned over the outer peripheral surface of each of the image carriers 18, which have been charged by the charging device 20 (charging roller 23), and thereby an electrostatic latent image is formed on the outer peripheral surface of each of the image carriers 18.

Developing devices 22 form visible toner images having yellow (Y), magenta (M), cyan (C), an black (K) colors by developing the electrostatic latent image formed on the image carrier 18.

The first transfer rollers 34Y, 34M, 34C, and 34K of the intermediate transfer unit 21, which are arranged above the image forming units 16Y, 16M, 16C, and 16K, multilayer-transfer the toner images having yellow (Y), magenta (M), cyan (C), and black (K) colors, which are formed on the image carriers 18, onto the intermediate transfer belt 32 that rotates.

The second transfer roller 42 second-transfers the toner images having different colors, which have been multilayer-transferred to the intermediate transfer belt 32 that rotates, to the recording medium P, which has been transported from the container 50 along the transport path 56 by the feed roller 52, the separation roller 54, and the positioning roller 58.

The recording medium P, to which the toner images are transferred, is transported to the fixing device 44, and the fixing device 44 fixes the toner images. The output rollers 46 output the recording medium P, onto which the toner images have been fixed, to the output section 48 that is arranged on the upper part of the apparatus body 10A of the image forming apparatus 10.

When forming images on both sides of the recording medium P, after the fixing device 44 has formed toner images onto the recording medium P, the output rollers 46 do not output the recording medium P to the output section 48, and the transport direction of the recording medium P is changed, so that the recording medium P is transported to the duplex transport path 62 by the transport rollers 60.

The recording medium P is reversed while being transported along the duplex transport path 62. The reversed recording medium P is transported to the positioning roller 58 again. This time, toner images are transferred to and fixed onto the back surface of the recording medium P, and the recording medium P is output to the output section 48 by the output rollers 46.

Figure 2:
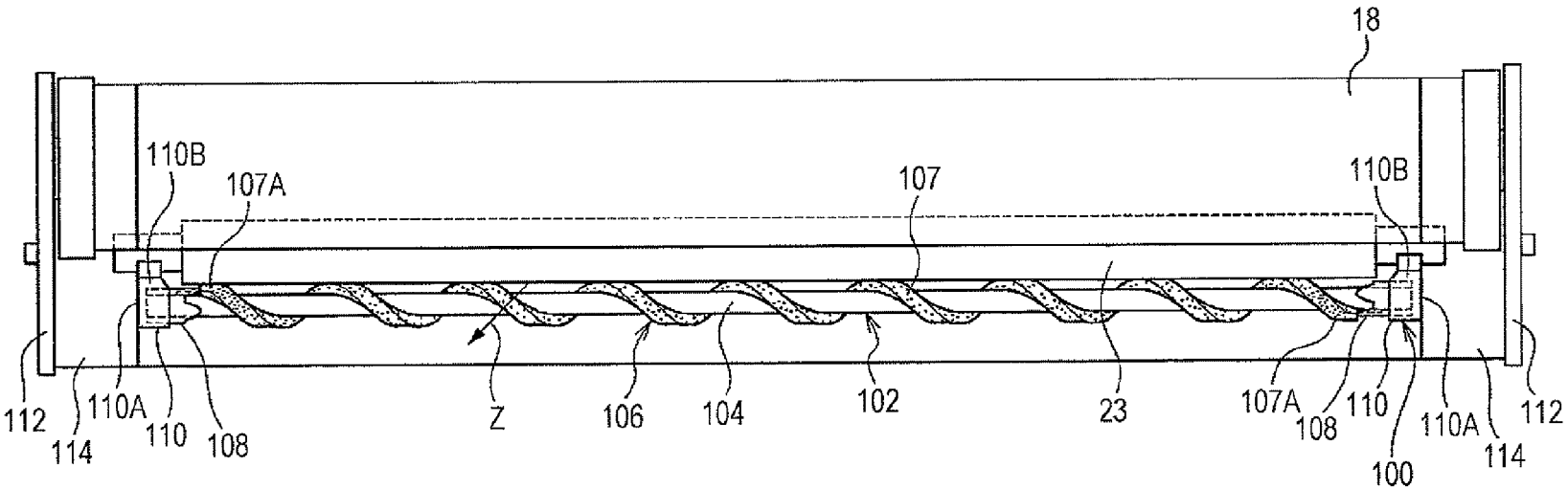
FIG. 2 is a schematic view illustrating the structure of a cleaning device.
Figure 3:
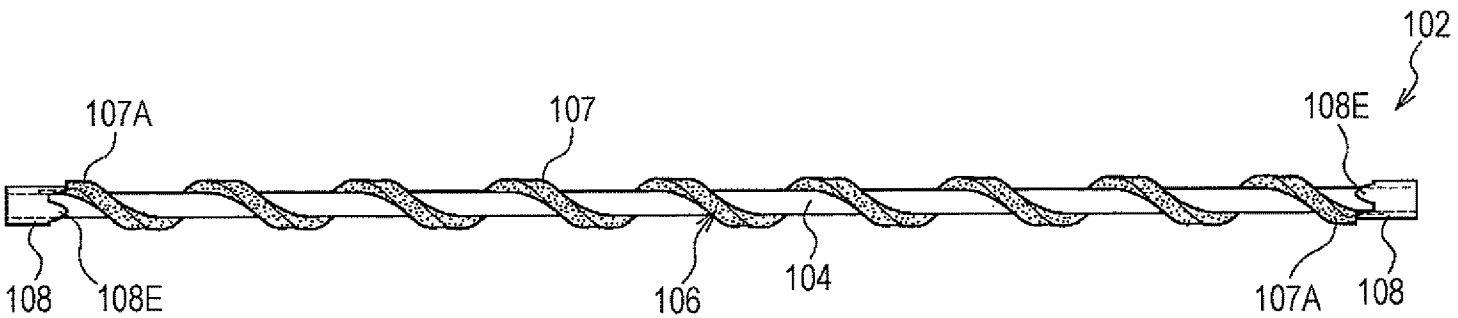
FIG. 3 is a schematic view illustrating the structure of a cleaning unit.

Next, the cleaning device 100 according to the present exemplary embodiment will be described in detail. As illustrated in FIGS. 2 and 3, the cleaning device 100 includes a cleaning unit 102 that cleans the charging roller 23, which is an example of an object to be cleaned. The cleaning unit 102 includes a shaft 104 and a cleaning member 106. The shaft 104 extends along the axis of the charging roller 23. The cleaning member 106 is spirally wound around and bonded to the outer peripheral surface of the shaft 104.

Figure 4:
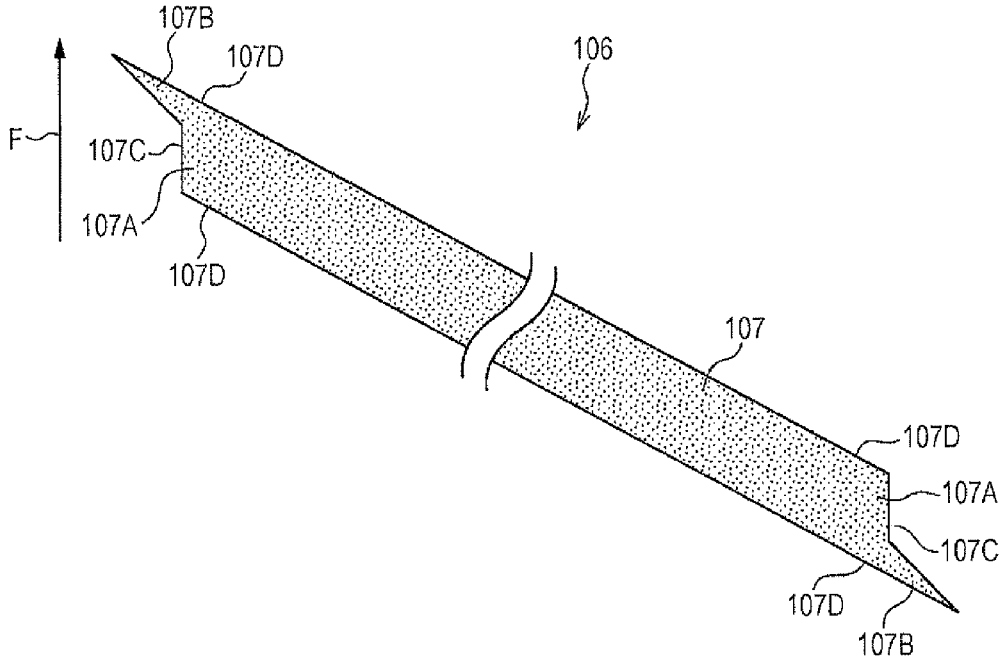
FIG. 4 is a plan view illustrating the shape of protrusions that are integrally formed with end portions of a cleaning member.

The shaft 104, which is made of a metal, extends along the axis of the charging roller 23. The shape of the shaft 104 excluding both end portions thereof is cylindrical. The cleaning member 106 includes an elastic layer 107 and an adhesive layer 105. The elastic layer 107 is strip-shaped (substantially shaped like an elongated parallelogram) as illustrated in FIG. 4 and is elastically deformable. The elastic layer 107 is bonded to the entire front surface of the adhesive layer 105 and the back surface of the adhesive layer is bonded to the shaft 104 (see FIG. 7).

The adhesive layer 105 includes an adhesive member, such as an adhesive or a double-sided adhesive tape. The cleaning member 106 is affixed (fixed) to the outer peripheral surface of the shaft 104 via the adhesive layer 105 so as to extend from one end portion to the other end portion of the shaft 104 in the axial direction. The adhesive layer 105 may include a single adhesive layer or multiple adhesive layers. When the adhesive layer 105 includes multiple adhesive layers, a non-adhesive layer, such as an electrically conductive layer, an electrically nonconductive layer, an electrically semiconductive layer, a thermally nonconductive layer, or a thermally conductive layer, may be arranged between the adhesive layers.

The elastic layer 107 is made of, for example, polyurethane foam (sponge) or the like. As illustrated in FIG. 4, protrusions 107B are integrally formed with two end portions 107A of the elastic layer 107 in the longitudinal direction. When the elastic layer 107 is wound around the shaft 104, the protrusions 107B extend outward in the axial direction of the shaft 104. The protrusions 107B are examples of a pressed portion. In the following description, the protrusions 107B are not included in the end portions 107A.

The protrusions 107B are pressed by a pressing member 108 described below (arranged between the pressing member 108 and the shaft 104). Each of the protrusions 107B protrudes from a part of the elastic layer 107 in the width direction and has an elongated triangular shape so that only a minimum required area is pressed by the pressing member 108.

As illustrated in FIG. 4, at one end (the left end) portion of the cleaning member 106 (elastic layer 107), the protrusion 107B is integrally formed with a part of the end portion on the downstream side in the rotation direction of the shaft 104 (indicated by an arrow F). At the other end (the right end) portion of the cleaning member 106 (elastic layer 107), the protrusion 107B is integrally formed with a part of the end portion on the upstream side in the rotation direction of the shaft 104. Thus, as illustrated in FIG. 4, the cleaning member 106 (elastic layer 107) has a shape that is point-symmetrical.

Figure 5:
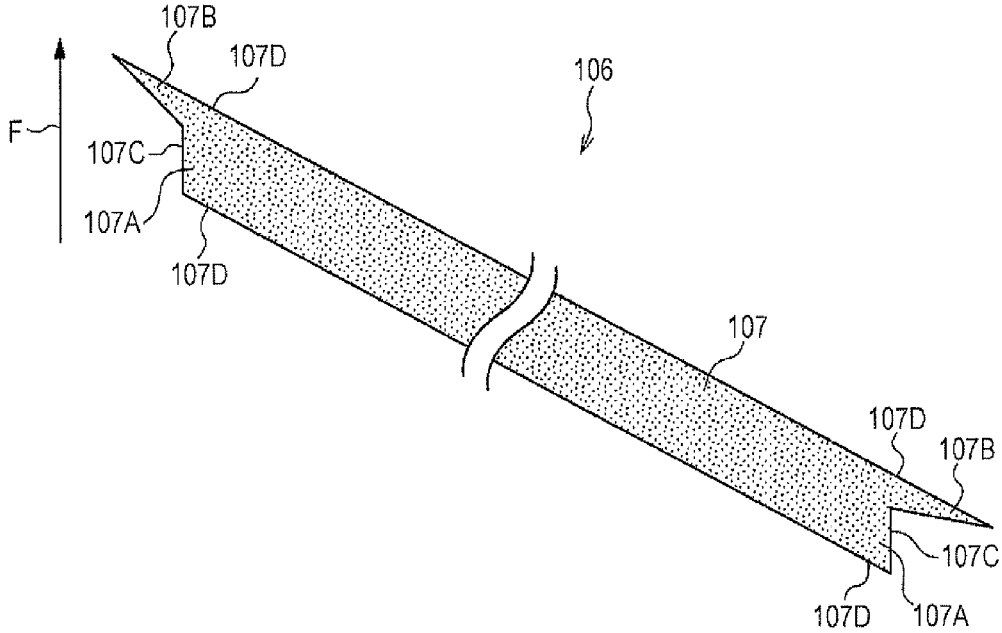
FIG. 5 is a plan view illustrating the shape of protrusions that are integrally formed with end portions of a cleaning member.

The cleaning member 106 (elastic layer 107) may have a shape illustrated in FIG. 5. That is, the protrusion 107B at the other end portion (the right end) of the cleaning member 106 (elastic layer 107) may be integrally formed with a part of the end portion on the downstream side in the rotation direction of the shaft 104. In this case, the protrusions 107B at both end portions of the cleaning member 106 (elastic layer 107) are arranged on the downstream side in the rotation direction of the shaft 104. Therefore, when the cleaning member 106 cleans the charging roller 23, the end portions 107A are not easily peeled off the shaft 104.

In either case, the protrusions 107B are integrally formed with the parts of the end portions 107A of the elastic layer 107 (cleaning member 106) in the width direction and only the protrusions 107B are pressed by the pressing member 108, whereby the end portions 107A that are integrally formed with the protrusions 107B are not pressed (covered) by the pressing member 108 and are exposed to the outside.

Therefore, as illustrated in FIGS. 4 to 8B, first ridge portions 1070 and second ridge portions 107D are formed in the end portions 107A that extend to edge portions of the pressing member 108 (including projecting portions 108E described below). The first ridge portions 107C, which are examples of a cleaning portion, extend in the circumferential direction of the shaft 104. The second ridge portions 107D, which are examples of a cleaning portion, extend in a direction that intersects the circumferential direction of the pressing member 108. Thus, the thickness of the elastic layer 107 excluding the protrusions 107B, i.e., the height of edge portions 106A described below, is made uniform from end to end. As a result, the performance of cleaning both end portions of the charging roller 23 in the axial direction is improved.

Figure 9:
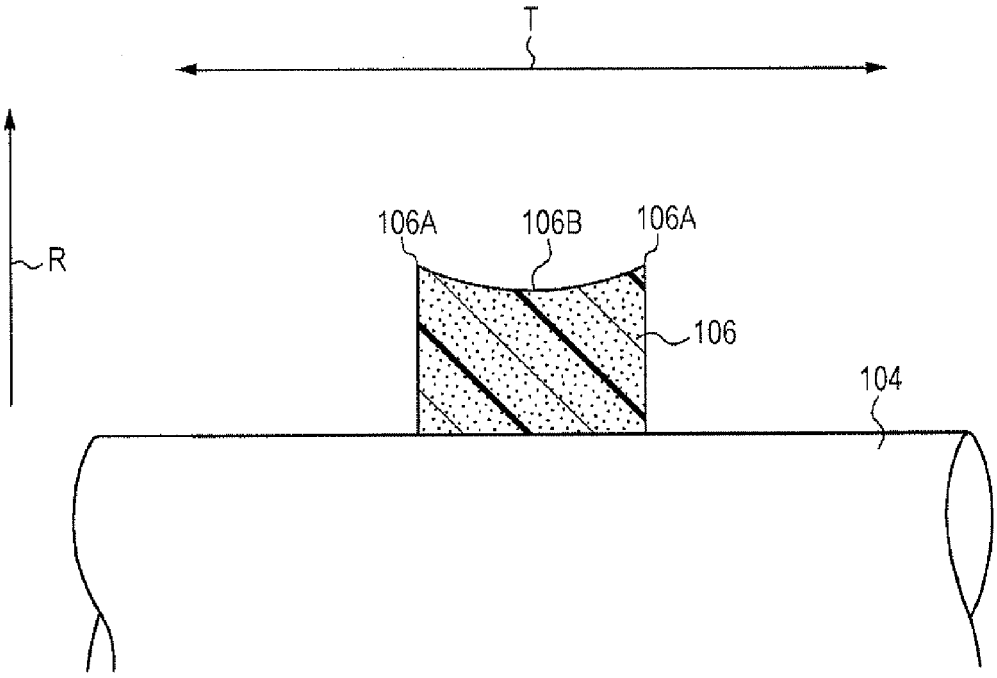
FIG. 9 is a schematic sectional view of a part of a shaft of the cleaning unit taken in the axial direction of the shaft.

That is, as illustrated in FIG. 9, a section of the cleaning member 106 taken in the axial direction T of the shaft 104 has a quadrangular shape having four sides (including a curve). The cleaning member 106 has the edge portions 106A, which project radially outward (in the direction of an arrow R in FIG. 9), at both end portions of the shaft 104 in the axial direction T. The edge portions 106A are formed, for example, by applying a tension to the cleaning member 106 and thereby generating a difference in the outside diameter of the cleaning member 106 between the edge portions 106A and a middle portion 106B of the outer peripheral surface (the upper surface in FIG. 9) of the cleaning member 106 in the axial direction T.

Likewise, a section of the cleaning member 106 taken in a direction perpendicular to the winding direction (in the direction of arrow Z in FIG. 2) has a quadrangular shape having four sides (including a curve). The cleaning member 106 has edge portions 106A, which project radially outward (in the direction of the arrow R in FIG. 9), at both end portions of the shaft 104 in the axial direction T. The outer peripheral surface (the upper surface in FIG. 9) of the cleaning unit 102 including the edge portions 106A contacts the charging roller 23 and thereby the shaft 104 is rotated.

Therefore, the outer peripheral surface of the cleaning member 106 cleans the outer peripheral surface of the charging roller 23 and the edge portions 106A scrape off foreign substances that adhere to the outer peripheral surface of the charging roller 23, thereby removing the foreign substances from the outer peripheral surface of the charging roller 23. Moreover, at both end portions of the charging roller 23 in the axial direction, the first ridge portions 107C and the second ridge portions 107D (edge portions 106A) scrape off and remove foreign substances, which remain on the outer peripheral surface at both end portions in the axial direction.

Figure 6:
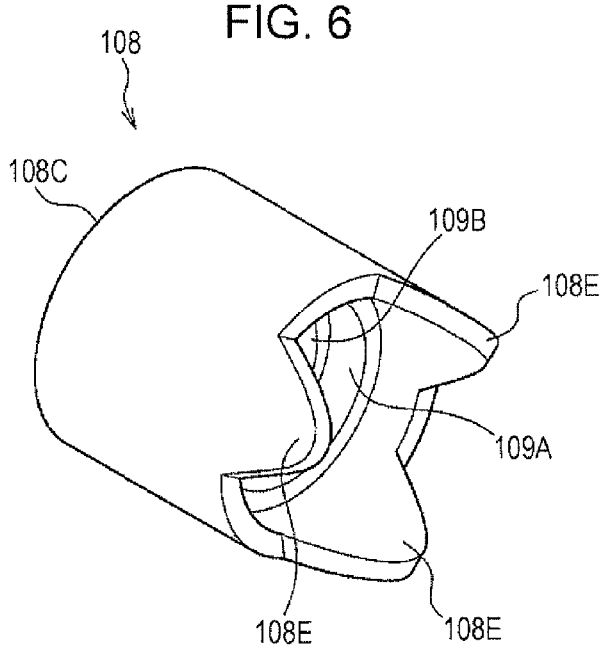
FIG. 6 is a perspective view illustrating the structure of a pressing member including projecting portions.
Figure 7:
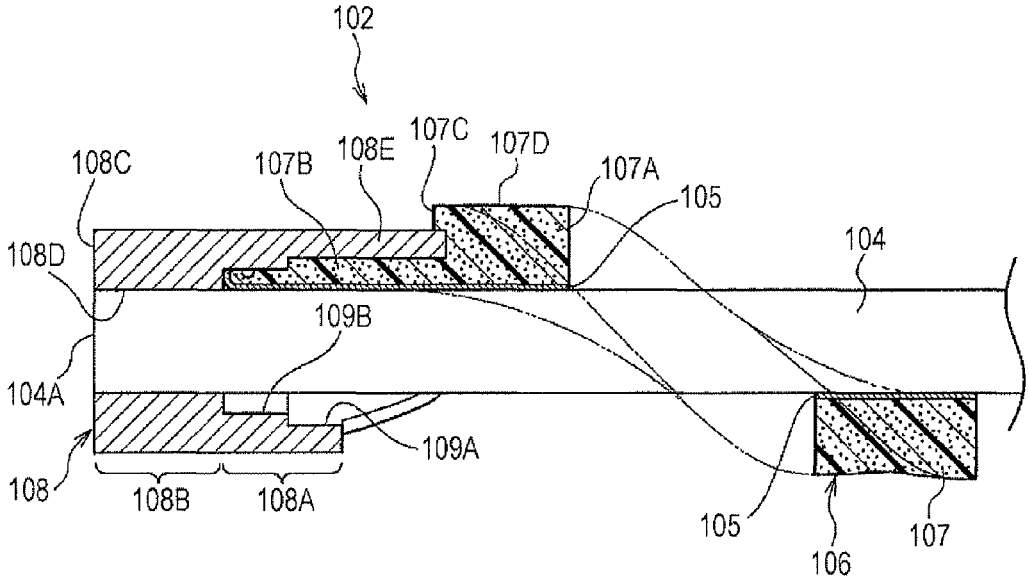
FIG. 7 is a sectional view illustrating the structure of an end portion of the cleaning unit.

On the other hand, as illustrated in FIGS. 6 and 7, the pressing member 108 is attached to each end portion of the shaft 104 in the axial direction. The pressing member 108 has a cylindrical shape and presses the protrusion 107B, which is integrally formed with the end portion 107A of the elastic layer 107, between the pressing member 108 and the shaft 104 (presses the protrusion 107B so that the protrusion 107B may not be peeled off the shaft 104).

On the inner peripheral surface of the pressing member 108, a cylindrical portion 108A and a holding portion 108B are integrally formed from the inside toward the outside in the axial direction. The cylindrical portion 108A forms a space between the pressing member 108 and the outer peripheral surface of the shaft 104. The holding portion 108B supports the shaft 104 that is inserted thereinto. That is, an insertion hole 108D, into which the shaft 104 is inserted, is formed in the holding portion 108B.

Each end portion of the shaft 104 that is inserted into the holding portion 108B is machined so as to have a sectional shape (such as a "D-cut") that prevents the shaft 104 from being rotated. By inserting both end portions of the shaft 104 into the insertion hole 108D, the holding portion 108B is held by the shaft 104 and the pressing member 108 rotates together with the shaft 104.

As illustrated in FIG. 7, the holding portion 108B is held by the shaft 104 at a position at which an end surface 108C of the holding portion 108B flushes with an end surface 104A of the shaft 104. However, the end surface 104A of the shaft 104 may be arranged inward of the end surface 108C of the holding portion 108B in the axial direction (on the right side in FIG. 7).

The cylindrical portion 108A is formed along the circumferential direction of the shaft 104. The cylindrical portion 108A includes a first-inside-diameter portion 109A and a second-inside-diameter portion 109B toward the end surface 1080 in order. The second-inside-diameter portion 109B has a smaller inside diameter than the first-inside-diameter portion 109A. Because the inside diameter of the first-inside-diameter portion 109A and the inside diameter of the second-inside-diameter portion 109B are different, a step is formed between the first-inside-diameter portion 109A and the second-inside-diameter portion 109B.

The second-inside-diameter portion 109B clamps the protrusion 107B of the elastic layer 107 and the adhesive layer 105 that is slightly entangled with the protrusion 107B between the second-inside-diameter portion 109B and the outer peripheral surface of the shaft 104, and presses the adhesive layer 105 and the protrusion 107B between the second-inside-diameter portion 109B and the outer peripheral surface of the shaft 104.

The first-inside-diameter portion 109A clamps the protrusion 107B of the elastic layer 107 and the adhesive layer 105 between the first-inside-diameter portion 109A and the outer peripheral surface of the shaft 104, and presses the adhesive layer 105 and the protrusion 107B between the first-inside-diameter portion 109A and the outer peripheral surface of the shaft 104. Thus, the first and second-inside-diameter portions 109A and 109B each function as a pressing portion that presses the protrusion 107B and the adhesive layer 105 between the first and second-inside-diameter portions 109A and 109B and the shaft 104.

In the above description of the present exemplary embodiment, the second-inside-diameter portion 109B clamps the adhesive layer 105 that is slightly entangled with the protrusion 1078 between the second-inside-diameter portion 109B and the outer peripheral surface of the shaft 104. However, the exemplary embodiment is not limited thereto. For example, when inserting the shaft 104 into the pressing member 108, the protrusion 107B and the like, from which the adhesive layer 105 has been peeled off and which has been accordion-folded, may be clamped between the second-inside-diameter portion 109B and the outer peripheral surface of the shaft 104.

In either case, the cleaning member 106 is temporarily bonded to the shaft 104 via the adhesive layer 105, and then an end portion of the shaft 104 is inserted into the insertion hole 108D in the holding portion 108B so as to attach the pressing member 108 to the shaft 104. As a result, an edge of the insertion hole 108D in the holding portion 108B peels off the adhesive layer 105, and the adhesive layer 105 is bonded to the inner peripheral surface of the second-inside-diameter portion 109B. Thus, both end portions of the cleaning member 106 are not easily peeled off the shaft 104.

As illustrated in FIG. 6, on the edge of the pressing member 108, three projecting portions 108E are integrally formed with the first-inside-diameter portion 109A at regular intervals in the circumferential direction. The projecting portions 108E are examples of a projection that projects inward in the axial direction of the shaft 104. The projecting portions 108E each have a substantially triangular shape. When the pressing member 108 is inserted into the shaft 104, the projecting portions 108E penetrate into an end surface at the end portion 107A of the elastic layer 107.

Therefore, the end portion 107A of the elastic layer 107, in particular, the second ridge portion 107D is supported by the projecting portions 108E and is not covered from the outside, while the first ridge portion 107C is exposed to the outside through spaces between the projecting portions 108E. Such a structure also serves to maintain the shapes of the first ridge portion 107C and the second ridge portion 107D (so that the first and second ridge portions 107C and 107D contact the outer peripheral surface of the charging roller 23).

In the present exemplary embodiment, the term "penetrate into" means not only to form a hole in the end surface of the end portion 107A but also to press and elastically deform the end surface of the end portion 107A. When the projecting portions 108E penetrate into the end surface of the end portion 107A, both end portions of the cleaning member 106 becomes less prone to being peeled off the shaft 104.

As illustrated in FIG. 2, the cleaning device 100 includes a pair of supporting members 110 that rotatably support the pressing members 108. To be specific, the supporting members 110 each include a substantially cylindrical body portion 110B whose inner side in the axial direction of the shaft 104 is open and whose outer side in the axial direction of the shaft 104 is closed by a side wall 110A. The pressing members 108 are rotatable together with the shaft 104 in the circumferential direction of the inner wall while sliding over the inner wall of the body portion 110B.

The supporting members 110 are fixed to fixing portions 114 that are formed on side plates 112. According to the present exemplary embodiment, end portions of the charging roller 23 in the axial direction are rotatably supported by the supporting members 110, and end portions of the image carrier 18 in the axial direction are rotatably supported by the side plates 112.

Next, the operation of the cleaning device 100 having the structure described above will be described. Foreign substances, such as developer, that have not been transferred to the intermediate transfer belt 32 and remain on the outer peripheral surface of the image carrier 18, are removed from the image carrier 18 by the cleaning member 24.

Foreign substances that have relatively small diameters, such as additives in the developer, are not removed by the cleaning member 24. Such additives and other foreign substance that are not removed by the cleaning member 24 adhere to the outer peripheral surface of the charging roller 23.

The outer peripheral surface (the upper surface in FIG. 9) of the cleaning member 106, including the edge portions 106A, contacts the charging roller 23 and removes the foreign substances that adhere to the outer peripheral surface of the charging roller 23. That is, the outer peripheral surface of the cleaning member 106 cleans the outer peripheral surface of the charging roller 23, and the edge portions 106A scrape off the foreign substances that adhere to the outer peripheral surface of the charging roller 23.

Figure 10A:
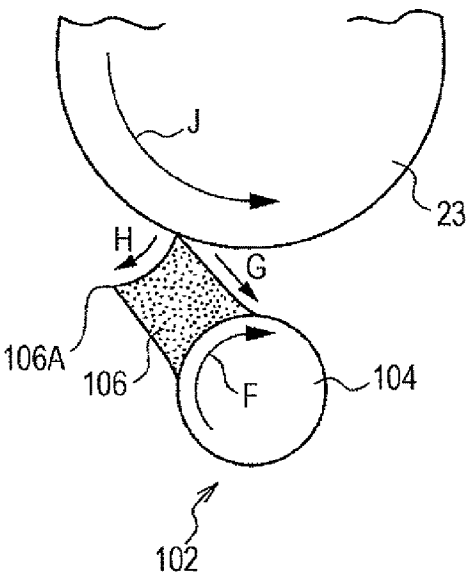
FIGS. 10A to 10C illustrate a cleaning operation performed by the cleaning unit.
Figure 10B:
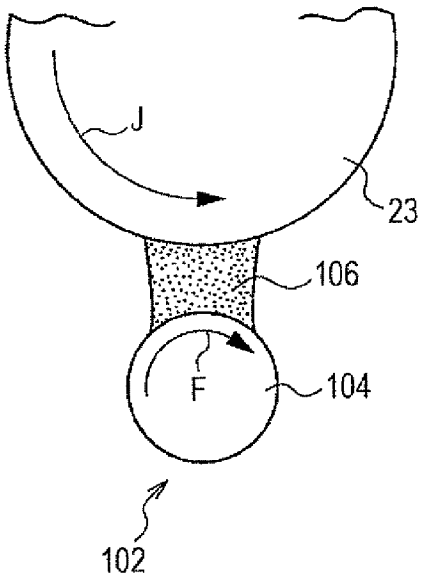

To be specific, as illustrated in FIGS. 10A and 10B, the cleaning unit 102, including the cleaning member 106, is rotated by the charging roller 23, which rotates in the direction of arrow J. The edge portions 106A of the cleaning member 106 are pressed against the outer peripheral surface of the charging roller 23 and are elastically deformed (elastically compressed) in the height direction of the cleaning member 106 (the direction G in FIG. 10A) and in the width direction (the direction H in FIG. 10A).

Figure 10C:
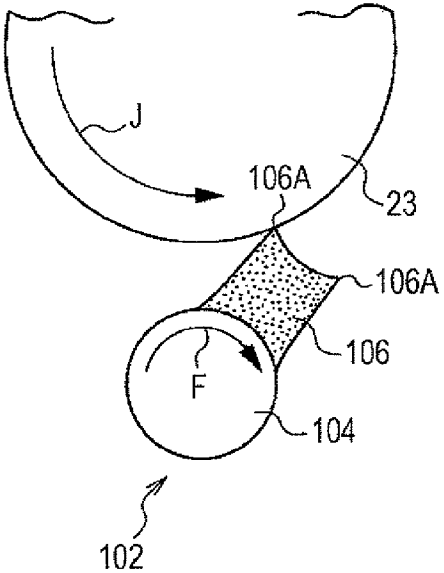

As a result, additives and other foreign substances that adhere to the outer peripheral surface of the charging roller 23 are pushed by the edge portions 106A and are collected. As illustrated in FIG. 10C, when the edge portions 106A recover their original shapes, the additives and the foreign substance, which have been collected, are crumbled or repelled from the outer peripheral surface of the charging roller 23.

Figure 8A:
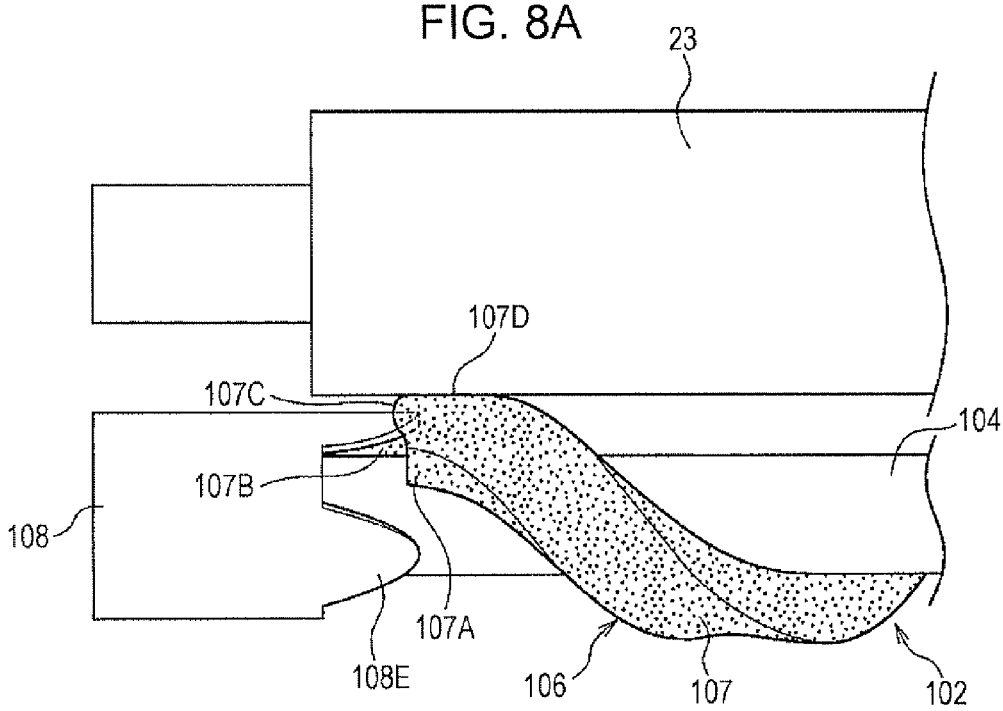
FIG. 8A is a schematic view illustrating the shape of an end portion of the cleaning unit according to an exemplary embodiment.

As illustrated in FIGS. 7 and 8A, in the cleaning unit 102 according to the present exemplary embodiment, only the protrusion 107B is pressed by the pressing member 108. The pressing member 108 is attached to the shaft 104 so that the projecting portions 108E penetrate into the end surface of the end portion 107A of the elastic layer 107.

Therefore, in the elastic layer 107 of the cleaning member 106, the end portion 107A, with which the protrusion 107B is integrally formed, is not covered (is not elastically deformed) by the pressing member 108. In the end portion 107A, the first ridge portion 107C extending in the circumferential direction and the second ridge portion 107D (edge portion 106A) extending in a direction that intersects the circumferential direction are formed.

Figure 8B:
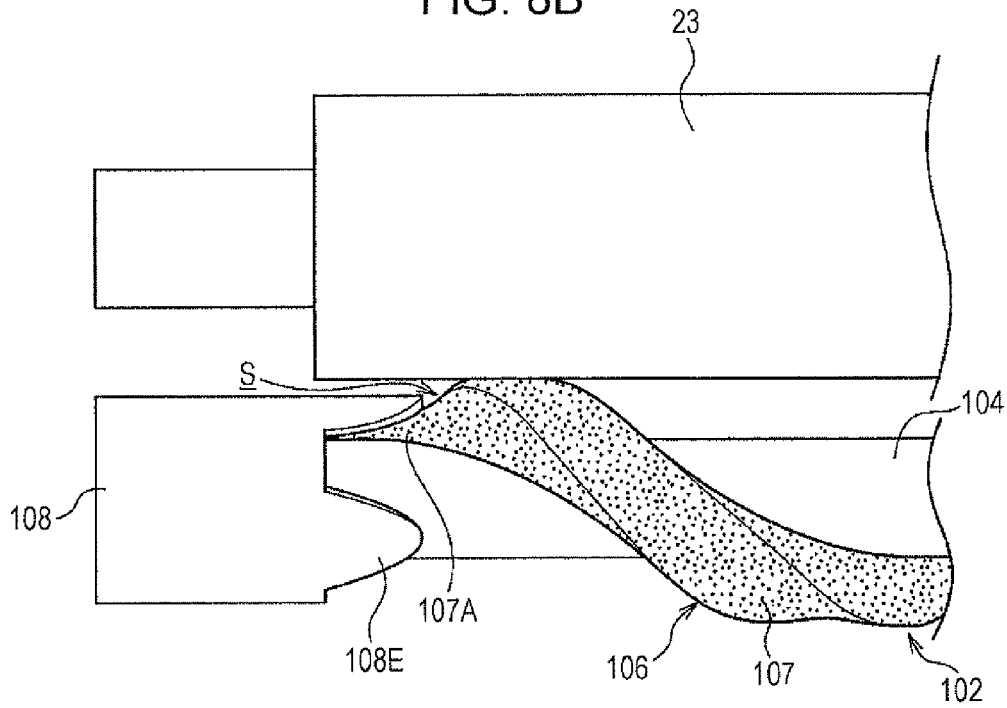
FIG. 8B is a schematic view illustrating the shape of an end portion of a cleaning unit according to a comparative example.

FIG. 8B illustrates a cleaning unit 102 according to a comparative example. In this cleaning unit 102, a pressed portion is formed over the entire width of the end portion 107A of the elastic layer 107, and the pressed portion is pressed by the first-inside-diameter portion 109A or the projecting portions 108E of the pressing member 108. In this case, a portion corresponding to a ridge portion (edge portion 106A) of the end portion 107A of the elastic layer 107 is covered (elastically deformed) by the first-inside-diameter portion 109A or the projecting portions 108E of the pressing member 108.

Therefore, a ridge portion (edge portion 106A) is not formed in the end portion 107A of this comparative example and the pressure against the end portion 107A is gradually reduced inward in the axial direction of the shaft 104, and thereby the end portion 107A has a shape such that a space S is formed between the end portion 107A and the outer peripheral surface of the charging roller 23.

As a result, the area of the elastic layer 107 that contacts both end portions of the charging roller 23 in the axial direction is reduced, whereby the performance of cleaning both end portions in the axial direction is reduced (cleaning failure occurs). In order to improve the cleaning performance, the length of the elastic layer 107 needs to be increased in the axial direction, so that the entire length of the image forming apparatus 10 is increased in the axial direction thereof.

In contrast, with the cleaning unit 102 according to the present exemplary embodiment, the end portion 107A of the elastic layer 107 is not entirely pressed by the pressing member 108 as illustrated in FIG. 8A. Instead, only the protrusion 107B, which is integrally formed with the end portion 107A, is pressed by the pressing member 108. Therefore, the first ridge portion 107C and the second ridge portion 107D (edge portion 106A) on the end portion 107A of the elastic layer 107 are exposed to the outside through spaces between the projecting portions 108E, so that the first and second ridge portions 107C and 107D are not elastically deformed by the pressing member 108 (including the projecting portions 108E).

Moreover, the projecting portions 108E of the pressing member 108 penetrate into the end surface of the end portion 107A of the elastic layer 107, so that the end portion 107A of the elastic layer 107 is supported by the projecting portions 108E. Therefore, the first ridge portion 107C and the second ridge portion 107D, which are exposed to the outside, have large areas, whereby the area of the elastic layer 107 that contacts both end portions of the charging roller 23 is large.

That is, the thickness of the end portion 107A of the elastic layer 107, which is integrally formed with the protrusion 107B that is pressed by the pressing member 108, is made substantially uniform. Thus, the size of the image forming apparatus 10 is made smaller than the case where the cleaning unit 102 according to the above comparative example is used, and the end portion 107A reliably contacts the end portion of the charging roller 23. Therefore, the end portions 107A of the elastic layer 107, which clean both end portions of the charging roller 23 in the axial direction, have substantially the same cleaning performance as the middle portion of the elastic layer 107.

EXAMPLES

Hereinafter, examples of the cleaning unit 102 will be described.

Example 1

A double-sided adhesive tape having a thickness of 0.2 mm was affixed to a polyurethane foam (EP-70; made by INOAC Corporation Ltd.) sheet having a thickness of 2 mm, and this sheet was cut into a strip having a width of 10 mm, a length of 360 mm, and a shape illustrated in FIG. 4. This strip was wound around a stepped metal shaft (having an outside diameter ϕ6 and a total length of 337 mm, including a bearing portion having an outside diameter of ϕ4 and a length 6 mm, and having an effective length of 320 mm around which the polyurethane foam sheet is wound) with a winding angle of 25° at both end portions in the axial direction of the shaft while applying a tension so as to extend the total length of the strip by the range of about 0% to 5%. A cap having the shape illustrated in FIG. 6 was attached to the bearing portion of the shaft so as to press the polyurethane foam sheet, so that the cleaning unit 102 was made, around which the polyurethane foam sheet was spirally wound.

Example 2

A double-sided adhesive tape having a thickness of 0.2 mm was affixed to a polyurethane foam (EP-70; made by INOAC Corporation Ltd.) sheet having a thickness of 2 mm, and this sheet was cut into a strip having a width of 10 mm, a length of 360 mm, and a shape illustrated in FIG. 5. This strip was wound around a stepped metal shaft (having an outside diameter ϕ6 and a total length of 337 mm, including a bearing portion having an outside diameter of ϕ4 and a length 6 mm, and having an effective length of 320 mm around which the polyurethane foam sheet is wound) with a winding angle of 25° at both end portions in the axial direction of the shaft while applying a tension so as to extend the total length of the strip by the range of about 0% to 5%. A cap having the shape illustrated in FIG. 6 was attached to the bearing portion of the shaft so as to press the polyurethane foam sheet, so that the cleaning unit 102 was made, around which the polyurethane foam sheet was spirally wound.

Comparative Example

A double-sided adhesive tape having a thickness of 0.2 mm was affixed to a polyurethane foam (EP-70; made by INOAC Corporation Ltd.) sheet having a thickness of 2 mm, and this sheet was cut into a strip (linear strip) having a width of 10 mm and a length of 360 mm. This strip was wound around a stepped metal shaft (having an outside diameter ϕ6 and a total length of 337 mm, including a bearing portion having an outside diameter of ϕ4 and a length 6 mm, and having an effective length of 320 mm around which the polyurethane foam sheet is wound) with a winding angle of 25° at both end portions in the axial direction of the shaft while applying a tension so as to extend the total length of the strip by the range of about 0% to 5%. A cap was attached to the bearing portion of the shaft so as to press the polyurethane foam sheet, so that the cleaning unit 102 was made, around which the polyurethane foam sheet was spirally wound.

The cleaning unit 102 according to the present exemplary embodiment has been described on the basis of the exemplary embodiment illustrated in the drawings. However, the cleaning unit 102 according to the present exemplary embodiment is not limited to the exemplary embodiment illustrated in the drawings, and may be modified in various ways. For example, the shaft 104 may protrude from the end surface 108C of the holding portion 108B, and the shaft 104 may be rotatably supported by a bearing instead of by the pressing member 108. The bearing may be a roller bearing or a slide bearing.

In the drawings, the pressing members 108 are attached to both end portions of the shaft 104 in the axial direction. However, depending on the structure of the cleaning unit 102, the pressing member 108 may be attached to only one end portion of the shaft 104 in the axial direction. That is, the pressing member 108 may be arranged at least one of the end portions of the shaft 104 in the axial direction.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A cleaning unit comprising:

a shaft that is rotatable;

an elastic layer that is spirally wound around and fixed to the shaft, the elastic layer contacting and cleaning an object to be cleaned;

a pressed portion that protrudes from each end portion of the elastic layer in an axial direction of the shaft, in a part of the each end portion with respect to a width direction of the elastic layer; and a pressing member that is arranged at an end portion of the shaft in the axial direction, the pressing member pressing the pressed portion between the pressing member and the shaft.

2. The cleaning unit according to claim 1, further comprising:

an end cleaning portion that is formed at the each end portion of the elastic layer when the pressed portion is pressed by the pressing member, wherein the end cleaning portion contacts with an end portion of the object to be cleaned and cleaning the end portion of the object to be cleaned.

3. The cleaning unit according to claim 2, wherein the pressing member includes a projecting portion that projects toward the shaft in the axial direction, the projecting portion is inserted into the end portion of the elastic layer.

4. The cleaning unit according to claim 3, wherein the pressed portion protrudes from a downstream side of the each end portion of the elastic layer in a rotation direction of the shaft.

5. A cleaning device comprising:

the cleaning unit according to claim 2, the cleaning unit rotates while contacting an object to be cleaned; and a supporting member that rotatably supports the pressing member.

6. The cleaning unit according to claim 1, wherein the pressing member includes a projecting portion that projects toward the shaft in the axial direction, the projecting portion penetrating into the end portion of the elastic layer.

7. The cleaning unit according to claim 6, wherein the pressed portion protrudes from a downstream side of the each end portion of the elastic layer in a rotation direction of the shaft.

8. A cleaning device comprising:

the cleaning unit according to claim 1, the cleaning unit rotates while contacting an object to be cleaned; and a supporting member that rotatably supports the pressing member.

9. A charging device comprising:

the cleaning device according to claim 8; and a charging member is the object to be cleaned that rotates.

10. An assembly comprising:

the cleaning device according to claim 8;

a member to be charged; and a charging member that charges the member to be charged, the charging member is the object to be cleaned that rotates, wherein the cleaning device, the member to be charged, and the charging member are assembled as a unit so as to be attachable to and removable from an apparatus body.

11. An image forming apparatus comprising:

an image carrier that is capable of holding an image;

the cleaning device according to claim 8;

a charging member that charges the image carrier, the charging member is the object to be cleaned that rotates;

an exposing device that exposes the image carrier to form an electrostatic latent image; and a developing device that develops an electrostatic latent image that is formed by the exposing device on the image carrier.

* * * * *